United States Patent [19]

Langsdon, Jr.

[11] 4,262,771

[45] Apr. 21, 1981

[54] SAFETY DEVICE FOR CROSSING RAILROADS

[76] Inventor: John K. Langsdon, Jr., P.O. Box 1018 Industrial Park, Columbia, Tenn. 38401

[21] Appl. No.: 9,521

[22] Filed: Feb. 5, 1979

[51] Int. Cl.[3] ..... B66F 11/04

[52] U.S. Cl. ..... 182/1; 182/115; 182/148

[58] Field of Search ..... 182/2, 148, 141, 1, 182/115, 116

[56] References Cited

U.S. PATENT DOCUMENTS

| | | | |
|---|---|---|---|
| 3,139,948 | 7/1964 | Rorden | 182/2 |
| 3,283,831 | 11/1966 | Bronder | 182/2 |
| 4,013,140 | 3/1977 | Pradon | 182/1 |

FOREIGN PATENT DOCUMENTS

| | | | |
|---|---|---|---|
| 1096578 | of 1958 | Fed. Rep. of Germany | 182/2 |
| 572428 | of 1958 | Italy | 182/2 |

*Primary Examiner*—Reinaldo P. Machado
*Attorney, Agent, or Firm*—Abe Hatcher

[57] ABSTRACT

An hydraulically operated bucket for lifting persons over railroad cars.

1 Claim, 3 Drawing Figures

TO HYDRAULIC SYSTEM
BOOM OUT
BOOM IN
EXTRA
ON-OFF
RIGHT
LEFT
UP BUCKET
DOWN BUCKET
10
12
14
16
18
20
22
24
26
28
30
30a
32
34
36
38
40
42

SAFETY DEVICE FOR CROSSING RAILROADS

BACKGROUND OF THE INVENTION

1. Field of the Invention

This invention relates to a safety device. More specifically, it relates to a derrick-type man-hoisting apparatus, for example, a so-called "cherry picker" unit having a fixed pivotal point on a tower to enable it to lift a person up and over a railroad car.

2. Description of the Prior Art

Accidents often occur when people in railroad yards attempt to go between or under railroad cars on a siding in a railroad yard. Therefore, development of a device which would enable them to cross the track without danger of being injured when a train on a siding begins to move represents a highly desirable result. After extended investigation I have found just such a device.

SUMMARY OF THE INVENTION

In its broader aspects my invention involves use of an hydraulically operated derrick or crane-type unit to lift a man over or across a railroad car from one side of a railroad track to the other. I prefer to use a conventional so-called "cherry picker bucket", such as often used when raising a person high enough off the ground to work on telephone or electric lines, having a pivotal point around which the jointed booms or arms of the unit turn or operate positioned on the platform of a derrick-like tower, which may be positioned on either side of the track, or, alternatively, so as to more or less straddle the track, with sufficient room left for a railroad car to pass beneath the platform.

DESCRIPTION OF THE DRAWING AND OF THE PREFERRED EMBODIMENTS OF THE INVENTION

Figures 1, 2:
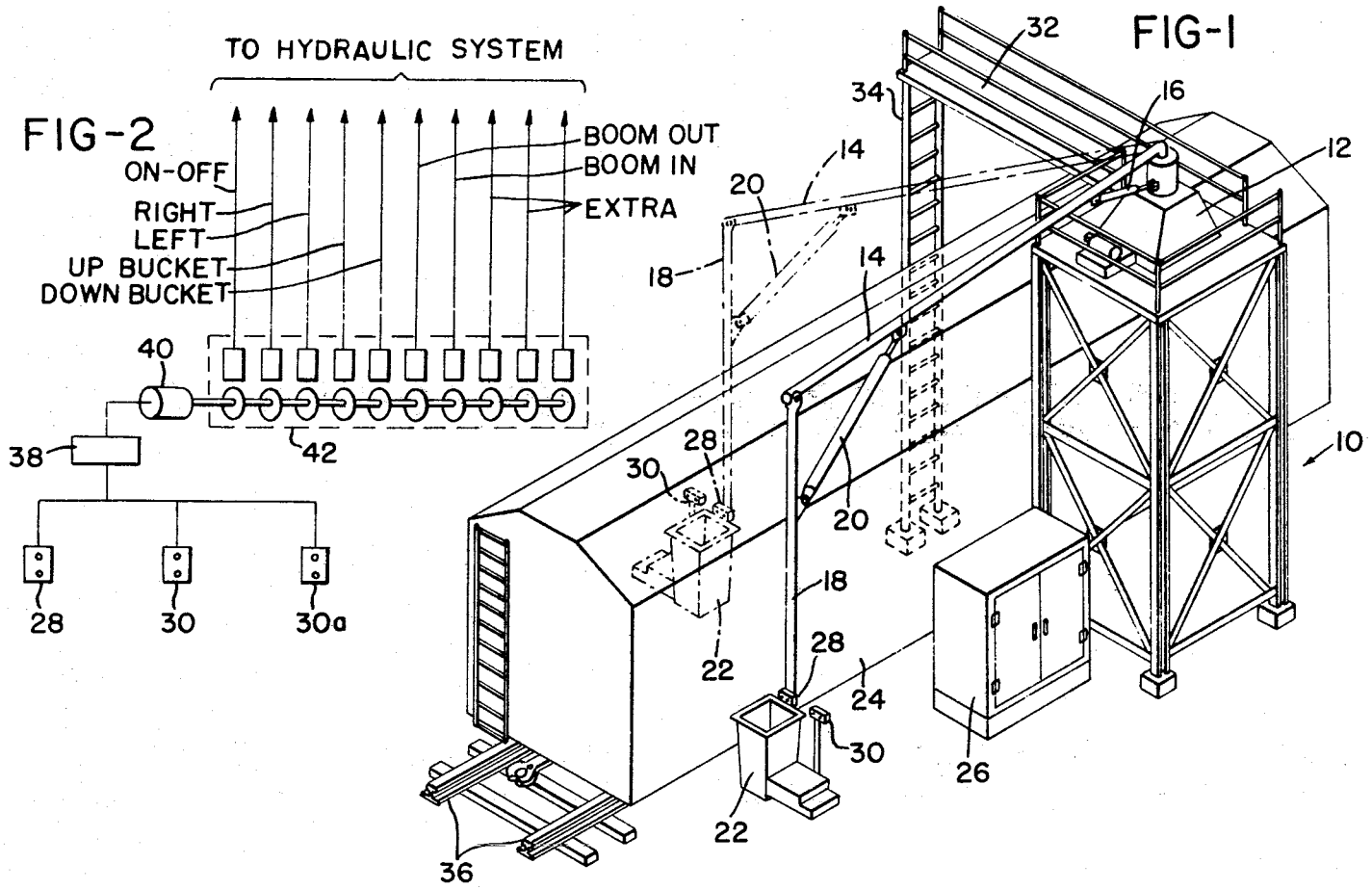
FIG. 1 is a perspective view of a safety unit according to the invention mounted on a tower positioned on one side of a railroad car located on a railroad siding.
FIG. 2 depicts schematically an hydraulic control unit such as may be used in operating a railroad crossover device such as that of the invention.
Figure 3:
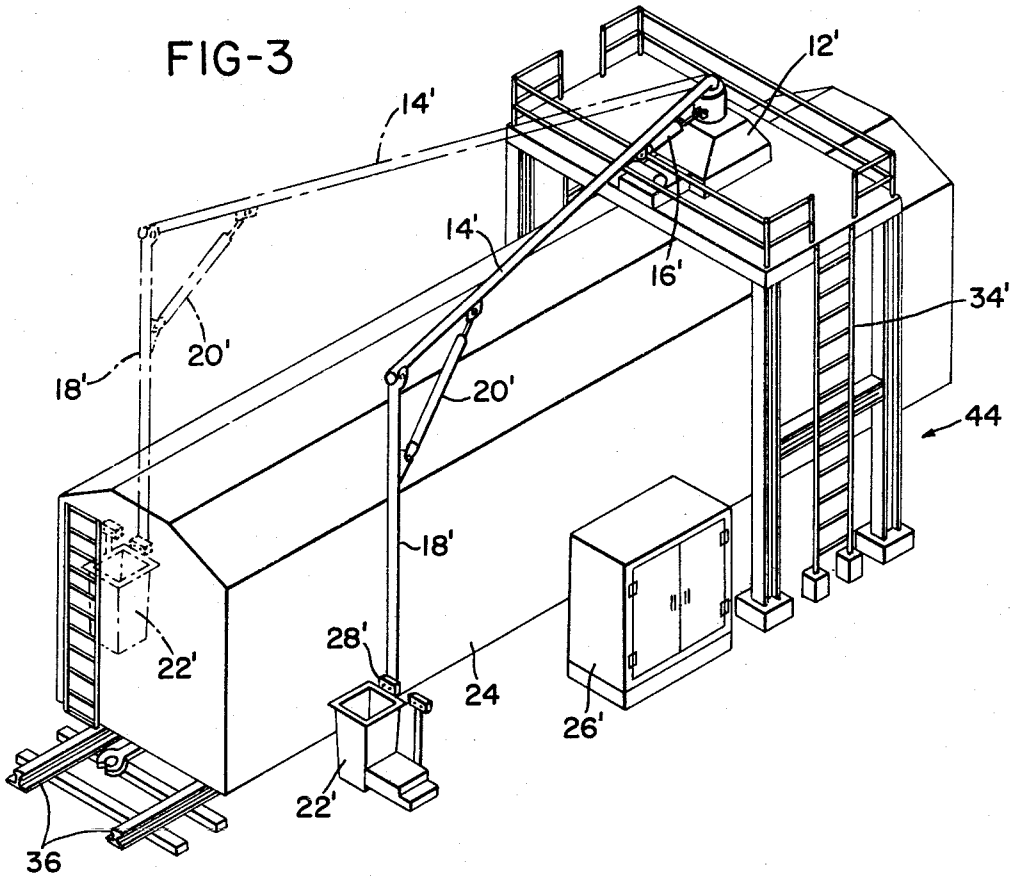
FIG. 3 is a perspective view of a safety unit according to the invention mounted in an alternative manner so that the tower on which it is mounted more or less straddles a railroad car sitting on a railroad siding.

In the drawing, a railroad crossover safety unit according to the invention is made up of a cherry picker unit 12, 12' positioned on an upper or elevated platform of a tower 10, 44 and having an upper boom 14, 14' which has an operating hydraulic cylinder 16, 16', and a vertical boom 18, 18' which has an operating hydraulic cylinder 20, 20' which raises a bucket 22, 22' sufficiently large to hold at least one person from a solid-line ground position to a dotted-line position and on up and over a railroad car such as depicted at 24 sitting on rails 36 to the opposite side thereof and back to the ground level, as a person (not shown) in bucket 22, 22' employs a regular on-off bucket control switch 28, a right on-off bucket control switch 30,30' and a left on-off bucket control switch **30*a*, connected to a switch box 38 and via a cam motor 40 to a cam servo 42, which may be operated through a conventional hydraulic system. The particular switch used or button pressed thus enables the person in the bucket to determine whether he or she stays on the ground or moves himself or herself upward, downward, to the right or to the left. A control cabinet 26 is provided, which may be locked to keep an unauthorized person from operating the unit. If a person so desires, he may, instead of using the safety lifting unit, cross over the railroad car 24 sitting on tracks 36 by climbing up ladder 34, 34', walking across walkway 32 of FIG. 2 or the platform on which the cherry picker unit 12' of FIG. 3 rests, and down the back portion of ladder 34, 34'**.

While the invention has been described in terms of preferred embodiments, the claims appended hereto are intended to encompass all embodiments which fall within the spirit of the invention.

Having thus described my invention and certain preferred embodiments thereof, I claim:

1. A railroad crossover safety device positioned adjacent a railroad track comprising an hydraulically operated man-moving unit having a pivotal point anchored on an above-the-ground platform of a permanent tower, which has four stationary rigid legs substantially perpendicular to a ground level, from which pivotal point at least one boom projects toward a bucket adapted to hold a person, said at least one boom being connected to said bucket at its end opposite said pivotal point, a ladder being provided leading from the ground to said platform from one side of said platform and said platform being provided with a walkway leading therefrom and crossing over said railroad track at at least the height of a railroad car, said walkway having a ladder at the end thereof opposite the platform end thereof of sufficient length to extend to said ground level.

* * * * *